US006820648B2

(12) United States Patent
Castagnetta, Jr.

(10) Patent No.: US 6,820,648 B2
(45) Date of Patent: Nov. 23, 2004

(54) POWERED PUMP ASSEMBLY WITH SELECTIVE RELIEF VALVE

(75) Inventor: David J. Castagnetta, Jr., Lawrenceville, GA (US)

(73) Assignee: Axia, Inc., Houston, TX (US)

( * ) Notice: Subject to any disclaimer, the term of this patent is extended or adjusted under 35 U.S.C. 154(b) by 107 days.

(21) Appl. No.: 10/390,868

(22) Filed: Mar. 17, 2003

(65) Prior Publication Data

US 2004/0182460 A1 Sep. 23, 2004

(51) Int. Cl.[7] ..... F16K 11/10
(52) U.S. Cl. ..... 137/625.11; 222/144.5
(58) Field of Search ..... 137/625.11, 635, 137/881; 222/144.5, 496

(56) References Cited

U.S. PATENT DOCUMENTS

| | | | | | |
|---|---|---|---|---|---|
| 3,785,535 | A | | 1/1974 | Ames | |
| 4,178,963 | A | * | 12/1979 | Riefler et al. | 137/624.18 |
| 4,440,410 | A | | 4/1984 | Bradshaw | |
| 4,538,640 | A | * | 9/1985 | Acker | 137/625.11 |
| 5,199,604 | A | * | 4/1993 | Palmer et al. | 222/146.5 |
| 5,230,608 | A | | 7/1993 | Januska | |
| 5,462,086 | A | | 10/1995 | Taylor et al. | |
| 5,497,812 | A | | 3/1996 | Orosco et al. | |
| 5,535,926 | A | | 7/1996 | Blitz et al. | |
| 5,570,953 | A | | 11/1996 | DeWall | |
| 5,613,511 | A | * | 3/1997 | Andersen et al. | 134/167 R |
| 5,711,462 | A | | 1/1998 | Hard | |
| 5,810,115 | A | * | 9/1998 | Mismas | 184/7.4 |
| 5,878,925 | A | | 3/1999 | Denkins et al. | |
| 5,887,569 | A | * | 3/1999 | Romanelli et al. | 123/450 |
| 5,924,598 | A | | 7/1999 | Bradshaw | |
| 6,116,769 | A | | 9/2000 | DeWall | |
| 6,161,954 | A | | 12/2000 | DeWall | |
| 6,294,034 | B1 | | 9/2001 | O'Mara et al. | |
| 6,299,686 | B1 | | 10/2001 | Mills | |
| 6,378,738 | B1 | | 4/2002 | Speaker et al. | |
| 6,428,287 | B1 | | 8/2002 | Denkins et al. | |

* cited by examiner

*Primary Examiner*—John Fox
(74) *Attorney, Agent, or Firm*—Michael Best & Friedrich LLP

(57) ABSTRACT

The invention provides a powered pumping system for filling various batch application tools with a viscous material. The system includes a motor mounted on a wheeled frame. The motor drives a slider-crank mechanism attached to a displacement pump. Affixed to the pump outlet is a relief valve having a plurality of predetermined relief pressure settings. The relief valve serves as a conduit between the pump and any one of various batch application tools while the tool is being filled with the viscous material. To initiate pumping, operators connect a filler valve of the tool to a relief valve outlet and actuate a switch. The relief valve of the present invention automatically selects a relief pressure appropriate for the particular tool based on certain physical characteristics of the particular tool. The selection of the appropriate relief pressure requires no operator intervention. Releasing the switch stops the pumping action.

23 Claims, 8 Drawing Sheets

POWERED PUMP ASSEMBLY WITH SELECTIVE RELIEF VALVE

FIELD OF THE INVENTION

The invention relates to a pump assembly for filling various drywall finishing and taping tools with a viscous material. More specifically, the invention relates to a pump assembly having a relief valve with a plurality of relief pressures.

BACKGROUND OF THE INVENTION

The building trades utilize many different tools for applying pastes, slurries and other viscous liquids, such as drywall compound, tile mastic, roofing asphalt and grout, to name just a few. At some building sites, application tools are connected by tubing, hoses or other conduits to a continuous supply of the viscous liquid, which is typically delivered under pressure. At other building sites, where the operator cannot be confined to the immediate vicinity of a pumping station, application tools are periodically filled with a batch of the viscous liquid.

Taper tools and finishing tools designed to carry a quantity of drywall compound for taping and finishing drywall joints are representative examples of the batch application tools. These tools have traditionally required frequent refilling with a hand-operated piston pump. For example, drywall compound is mixed with a solvent in a bucket or other storage container to produce the desired consistency, and then the cylinder of the hand-operated pump is placed in the bucket. An appropriate adaptor is mounted on an outlet of the hand-operated pump, between the outlet and the tool. The taper tools and the finishing tools are filled by manipulating a handle of the hand-operated pump in an up-and-down motion. One example of a hand-operated pump system is described in U.S. Pat. No. 6,378,738 B1, issued to Speaker et al. Another example is described in U.S. Pat. No. 5,711,462, issued to Hard.

Empirical measurements, using properly mixed compound, reveal that a force in excess of 30 pounds of force must be exerted on the handle of a typical hand-operated pump. This fact, coupled with the position of the handle at the bottom of the down-stroke, usually about 10 inches from the ground, can make for an awkward, tiring and sometimes painful experience as the operators are constantly bending over during fillings.

In order to reduce the strain on the operators, previous pump designers have attempted to develop alternate methods for supplying drywall compound to the tools. For example, one previously disclosed system described in U.S. Pat. No. 5,497,812, issued to Orosco et al., utilizes a reciprocating air cylinder attached directly to the cylinder of an existing hand-operated pump. While these alternate systems are commendable and may reduce operator fatigue to some extent, the alternate systems have not been very well received in the field. Possible reasons that the building trades have been reluctant to adopt these alternate systems include mechanical complexity, lack of compressed air (to power pneumatic cylinders etc.), size, portability, ease of cleanup and/or cost.

Another reason that the building trades have been reluctant to adopt air-powered pumping systems is that various batch application tools require overpressure protection at different pressure relief set points. For example, a taper tool known as the Bazooka™ is commercially available from Ames Tool Corporation, the assignee of the present invention. The Bazooka™ requires a relatively large volume of drywall compound delivered at a comparatively low pressure. In contrast, a finishing tool known as the MudRunner™, also available from Ames Tool Corporation, has a relatively small capacity, but requires a significantly greater fill pressure to overcome the force of an internal gas spring/piston assembly. Test results indicate that the optimal fill pressure for the MudRunner™ is approximately one and one-half times the fill pressure of the Bazooka™. Consequently, any powered pumping assembly used to fill both of these tools must be capable of providing two, distinct pressure relief set points and volumetric relief capacities. Because these tools are routinely used in close proximity to each other at a construction site, building contractors would welcome a pumping system that could serve both.

This need for two or more distinct pressure relief set points is shared by other pairs of batch application tools that might reasonably be expected to be used at the same construction site. A need exists for a simple and reliable powered pumping assembly for filling various tools that does not require a source of compressed air to operate. The new pumping assembly should be rugged, lightweight and easily portable. Building tradesmen should be able to operate the new pumping assembly, without need for any new skills or special training. The new system should provide overpressure protection suitable for more than one type of batch application tool with different pressure requirements.

SUMMARY OF THE INVENTION

The invention is a powered pumping system for filling various batch application tools with a viscous material. The system includes a motor mounted on a wheeled frame. The motor drives a slider-crank mechanism attached to a reciprocating displacement pump. Affixed to the pump outlet is a relief valve having a plurality of predetermined relief pressure settings. The relief valve serves as a conduit between the pump and any one of various batch application tools while the tool is being filled with the viscous material.

To initiate pumping, operators connect a filler port of the tool to a relief valve outlet and actuate a switch, such as a foot pedal. The relief valve of the present invention automatically selects a relief pressure appropriate for the particular tool based on certain physical characteristics of the particular tool. The selection of the appropriate relief pressure requires no operator intervention. Releasing the switch stops the pumping action immediately. Because the processes of connecting the tool filler port to the relief valve outlet, and determining whether the tool is completely filled, are identical to those employed with the widely-used traditional hand-operated pump, operators will quickly and naturally establish a "comfort level" of competence with the inventive pumping system.

In one embodiment, the invention is a relief valve for connecting to either of at least two tools or vessels. Each of the vessels has a different overpressure protection requirement and a distinctive pressure connector. The relief valve includes a body, an inlet, and a discharge outlet. A first pressure relief outlet provides the overpressure protection required by one of the vessels, while a second pressure relief outlet provides the overpressure protection required by the other of the vessels. A selector member, also known as a pressure insert, located in the body of the relief valve is actuated by one of the vessels' pressure connectors and not the other vessel's pressure connector when the relief valve's discharge outlet is connected to the vessels, respectively. When actuated, the selector member or pressure insert blocks flow to the relief valve's first pressure relief outlet or the second pressure relief outlet. The relief outlet that has the lowest pressure setpoint and is not blocked will open to protect the vessel.

The relief valve is equipped with a first spring-loaded piston and seat assembly that is adjusted to provide the overpressure protection requirement of one of the vessels. Another spring-loaded piston and seat assembly provides the overpressure protection requirement of the other of the vessels. The piston and seat assemblies are positioned between the inlet and the first and second pressure relief outlets, respectively. The selector member is actuated by a pressure connector having a protrusion inserted at least a predetermined distance into the discharge outlet.

In another embodiment, the invention is a relief valve for protecting two different batch application tools, each with a different pressure connector. The relief valve includes a body, an inlet, and a discharge outlet. Two separate pressure relief outlets provide the overpressure protection required by each of the tools, respectively. A pressure insert is actuated by one and only one of the tool's pressure connectors when the discharge outlet is connected to the tools. Actuating the selector member blocks flow to one of the pressure relief outlets.

The relief valve may include a relief channel having a mouth that communicates with the body. The pressure connector actuates the selector member by forcing it away from the discharge outlet, so that the selector member covers the mouth. Preferably, the mouth is surrounded by a dam and the selector member includes a depression for receiving the dam when the selector member is actuated. The combination of the selector member and the dam stops any flow from passing through the lower pressure relief outlet until that particular tool is disconnected from the discharge outlet.

In still another embodiment, the invention is a pumping system for filling a variety of taper tools and drywall finishing tools. Each of the tools has one of two different overpressure protection requirements and a pressure connector that is indicative of the tool's protection requirement. The pumping system includes a motor, a powered pump, and a selective relief valve, as described above.

The present invention offers a simple, portable and cost effective pumping system for the filling of batch application tools. Strain on operators is significantly reduced by the elimination of tiresome hand pumping. The pumping system unit is suitable for use with readily-available electrical current, is easily cleaned and requires minimal training to operate. It is capable of filling a wide range of tools without operator adjustment or danger of over-pressurization.

DETAILED DESCRIPTION OF PREFERRED EMBODIMENTS OF THE INVENTION

Figure 1:
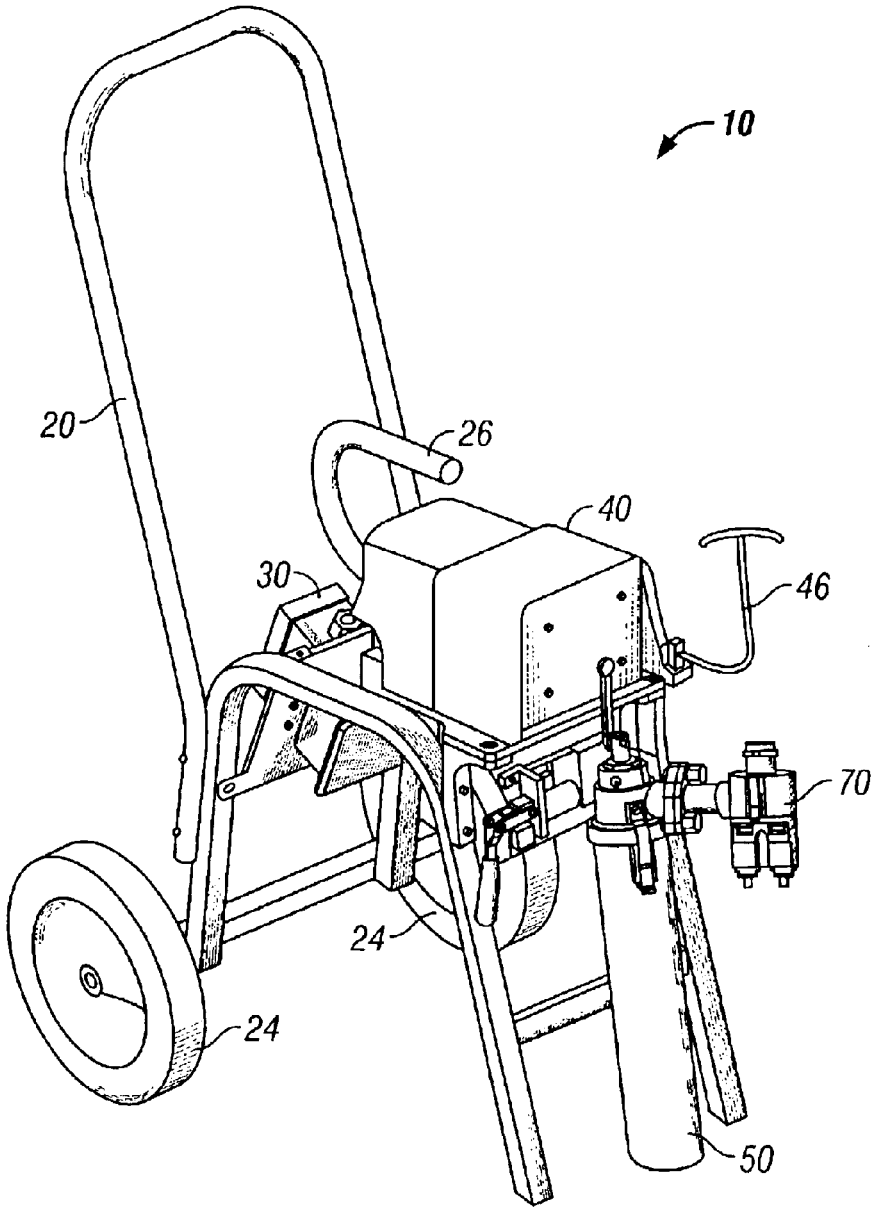
FIG. 1 is a perspective view of a pumping system of the invention, including a motor, a pump and a relief valve.

In a preferred embodiment shown in FIG. 1, the invention is a pumping system 10 for filling manually-operated drywall taping and finishing tools. Pumping system 10 includes electric motor 40, which receives electrical current through electrical receptacle 30. Motor 40 and receptacle 30 are mounted on frame 20, which is constructed of aluminum to reduce weight and enhance mobility. Relief valve 70 communicates with the discharge of pump 50. Cradle 46 is useful for supporting tools (not shown) while they are being filled by pump 50. Cradle 46 is rotatably mounted on frame 20, so that it can be positioned out of the way when not being used for support. Handle 26 is used for rotating frame 20 around wheels 24, so that pump 50 may be lifted from and lowered into a container of drywall compound (not shown).

Figure 2:
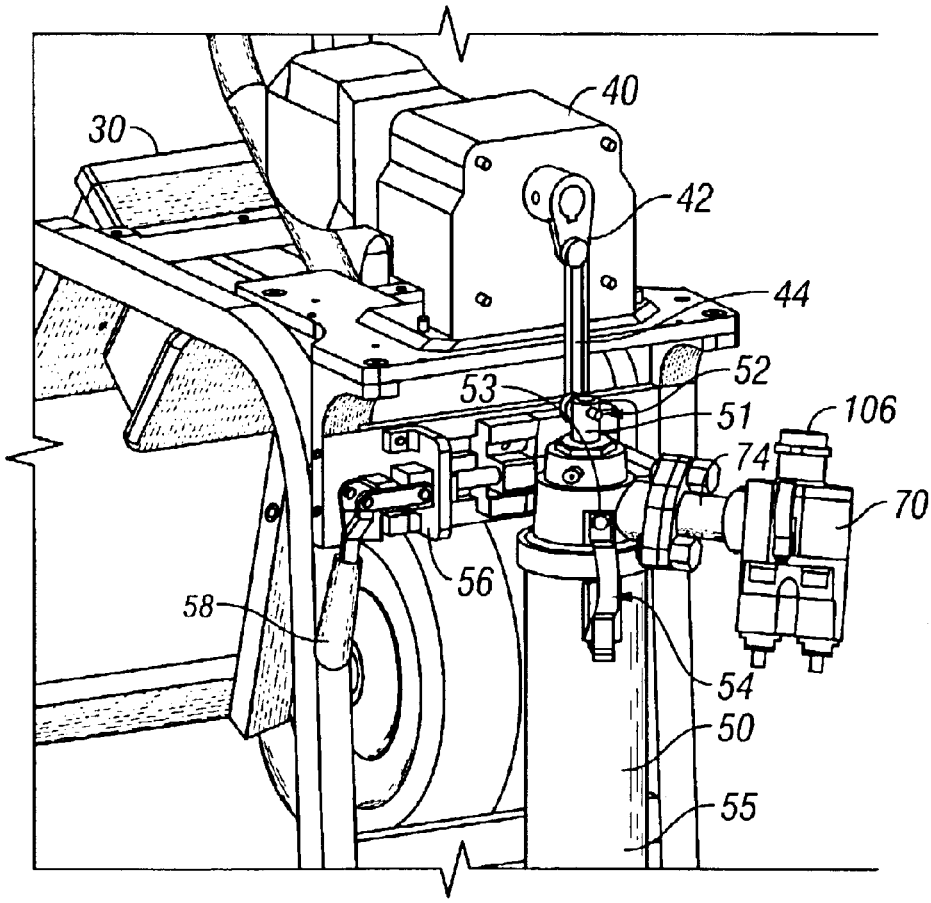
FIG. 2 a close-up perspective view of the pumping system of FIG. 1.

As shown in FIG. 2, motor 40 drives a slider-crank mechanism that includes crank 42 and connecting rod 44 for converting rotary motion to reciprocating motion. Displacement pump 50 houses piston 51, which is releasably attached to rod 44 by quick-release pin 52. A ball detente is incorporated in pin 52, so that piston 51 can be quickly and reliably attached to each other and released. Pump 50 is removably mounted on frame 20 by toggle clamp 56, which is actuated by handle 58. When pin 52 has been removed from piston 51 and pump 50 has been removed from toggle clamp 56, cap 53 may be separated from body 55 of pump 50 by releasing two latches 54, which are located on either side of pump 50.

The quick-release and removable mounting mechanisms make it easy for an operator to remove and disassembly pump 50 for cleaning. This is an important advantage, because some types of drywall compound are so fast-setting that they must be used or removed from drywall taping and finishing tools within twenty minutes after filling. Pump 50 otherwise resembles a hand-operated pump traditionally used for pumping drywall compound.

Relief valve 70, which is a selective valve having two independently set relief pressures, is connected to pump 50 and serves as a conduit for successively filling pressure vessels, such as various taping and finishing tools (not shown). Relief valve 70 provides over-pressure protection for any particular one of the tools (not shown) which is being filled.

Motor 40 may be, for example, an electric gearmotor of appropriate tool fill speed, torque and input voltage/current. A 115-volt alternating current induction motor is preferred. Alternatively, other types of motors may successfully be employed, such as a compressed air motor or a gasoline powered motor, among others. While readily available in factory environments, compressed air is not always accessible at commercial construction sites and even less accessible at residential construction sites. Gasoline powered motors are not favored for indoor use because of their exhaust fumes. The 115-volt alternating electric current is widely available at nearly all construction sites. In addition, receptacle 30 includes a duplex outlet (not shown) to allow finishers to power other devices such as mixing drills and lights.

When motor 40 is an electric induction gearmotor, it can be expected to turn at a substantially constant speed regardless of load. Consequently, overpressure protection at the discharge of pump 50 is necessary to protect the tool (not shown) from mechanical damage. When the pressure at the discharge of pump 50 tool reaches a predetermined setpoint, relief valve 70 opens to relieve pressure and return excess drywall compound to the bucket or storage container (not shown). The predetermined relief pressure setpoint and volumetric relief requirement are dictated by the strength and size of the particular tool being protected.

Because taper tools and finishing tools are designed to accomplish different functions, it is not surprising that they cannot all be protected by a single relief pressure. Relief valve 70 utilizes physical differences between certain taper tools and finishing tools to select the appropriate relief setting for filling either of the tools.

Referring now to FIG. 2, inlet adapter 74 of relief valve 70 is attached to the discharge of pump 50, where it is sealed by means of a gasket (not shown). Outlet 106 of relief valve 70 mates with a pressure connector, such as filler tube 162 or 182, shown in FIGS. 5–6, of the tool being filled. O-ring 108 (best seen in FIG. 3) creates a seal around filler tube 162 or 182 to prevent leakage of the drywall compound.

Figure 3:
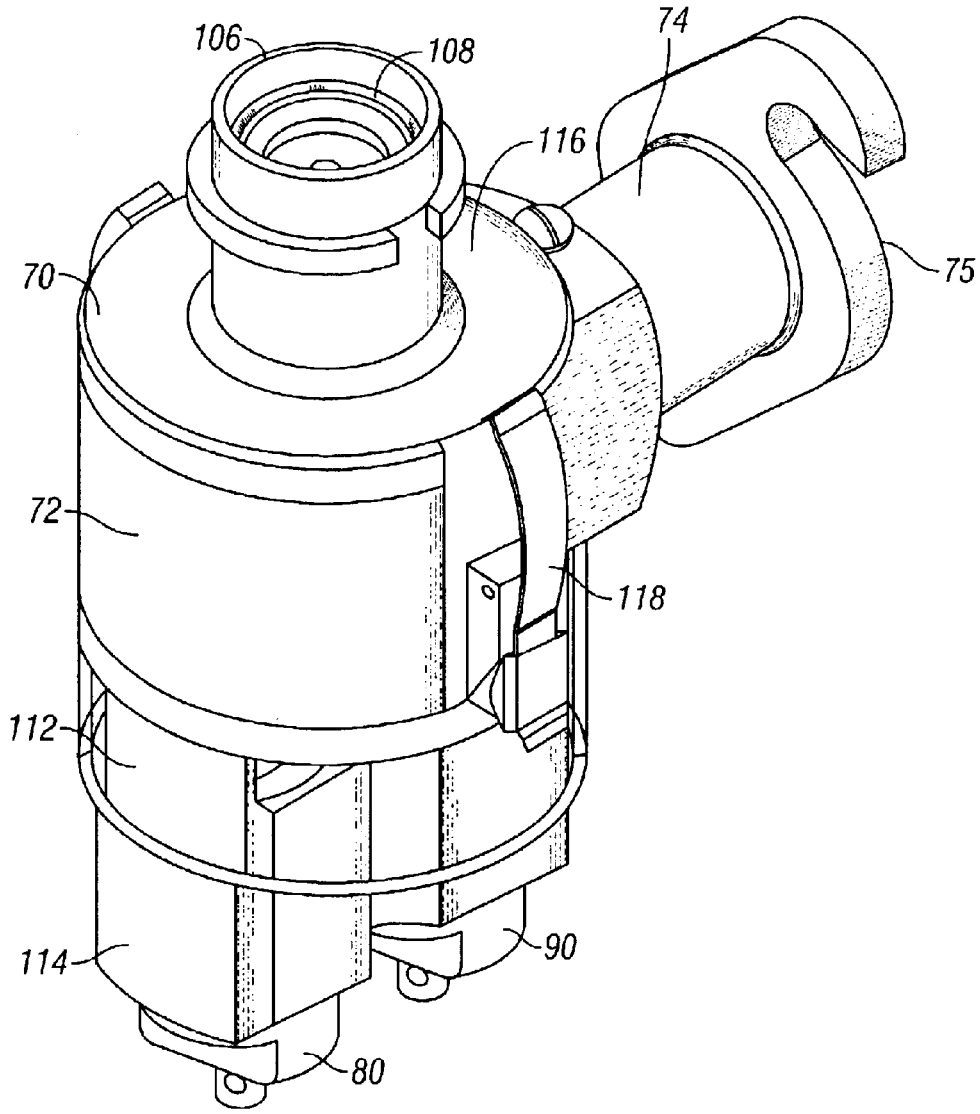
FIG. 3 is a perspective view of the relief valve depicted in FIG. 1.

As shown in FIG. 3, relief valve 70 includes valve body 72, which is closed at opposite ends by cap 116 and base plate 114, respectively. Latches 118 on either side of body 72 can be released to disengage cap 116 for cleaning. All of the internal components (best seen in FIG. 3) of body 72 are securely mounted to body 72, so that cap 116 can be removed and the interior of body 116 can be flushed without displacing or losing any of the internal components. The normal flow of drywall compound is from inlet adapter 74 to inlet 75, through body 72 to outlet 106, and into the tool being filled (not shown). Transparent splash shield 112 permits visual inspection of relief outlets 83, 93 (best seen in FIGS. 5–6), while protecting the operator from splattering in the event of an unexpected release of drywall compound.

Figure 4:
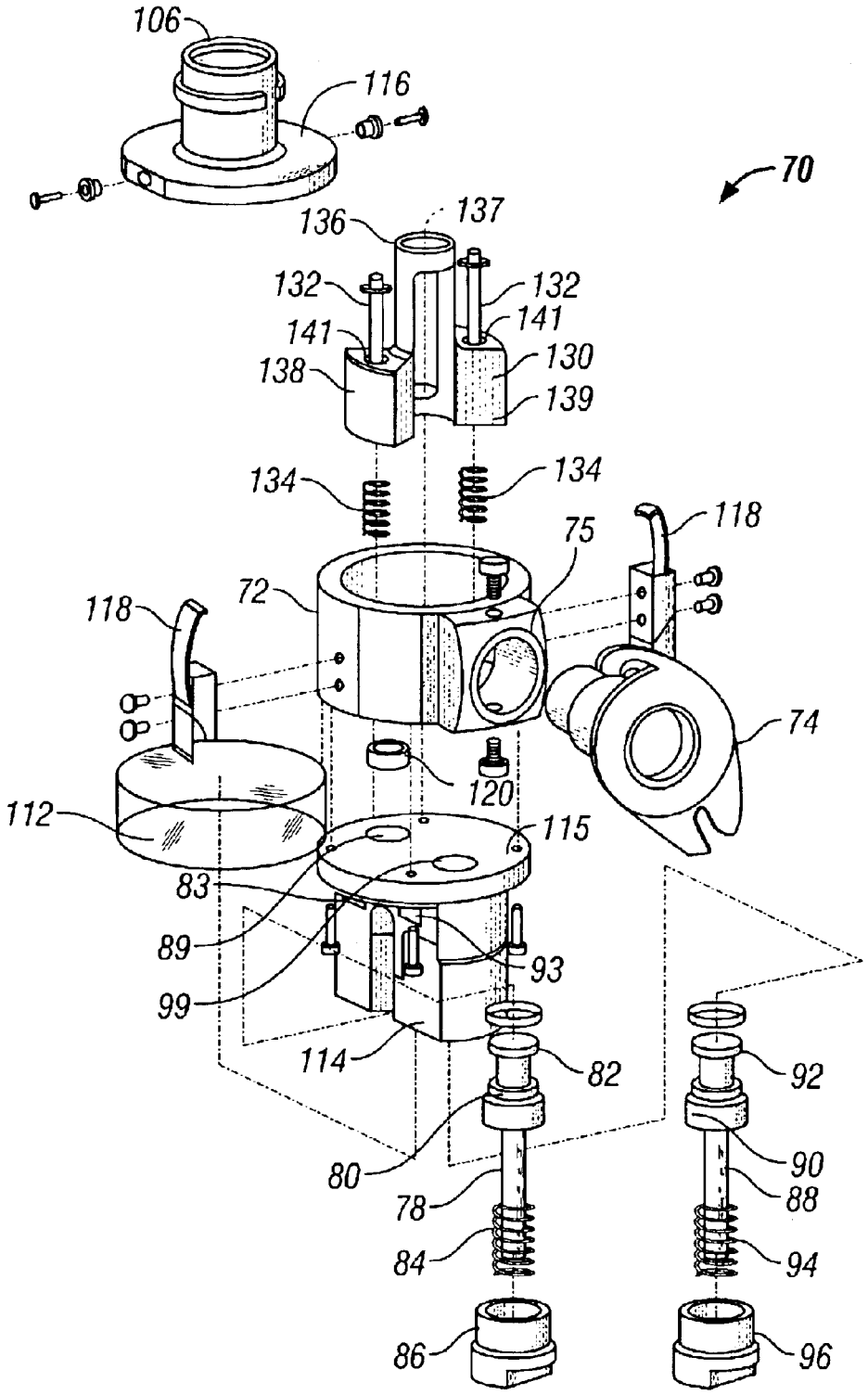
FIG. 4 is an exploded view of the relief valve depicted in FIG. 1.

FIG. 4 illustrates how the components of relief valve 70 are assembled. High and low pressure piston assemblies 80, 90 each include a seat 82, 92; a rod 78, 88; a compression spring 84, 94; and a spring-compressing calibration nut 86, 96, respectively. The piston assemblies 80, 90 are inserted into mating channels 89, 99, which extend completely through base plate 114. Relief outlets 83, 93 communicate with mating channels 89, 99, respectively. Inside the channels 89, 99 are seats (not shown) to mate and seal with seats 82, 92 for closing relief outlets 83, 93, respectively, during normal operation. Dam 120 is partially inserted into the interior end of recess 89. Base plate 114 is inserted into body 72 and fastened together with screws.

On either side of pressure insert or selector member 130, two spring guides 132 are inserted into corresponding holes 141 located in pillar portions 138 and 139, respectively. Mantle portion 140 (best seen in FIGS. 7–8) extends between and connects pillar portions 138, 139 to each other. Guides 132 emerge from holes 141 to pass respectively through a pair of bias springs 134 and fasten at internal face 115 of base plate 114. Pressure insert 130 is positioned relative to base plate 114 so that depression 131 (best seen in FIG. 8) in mantle portion 140 aligns with dam 120. Bias springs 134 hold pressure insert 130 held away from interior face 115 of base plate 114 during normal operation. Cap 116, inlet adapter 74, latches 118 and transparent shield 112 are attached to body 72 to complete the assembly. Subsequently, the relief settings of piston assemblies 80, 90 are each calibrated by adjusting calibration nuts 86, 96 so that seats 82, 92 each open and seal in response to known pressures maintained inside relief valve 70.

Figure 5:
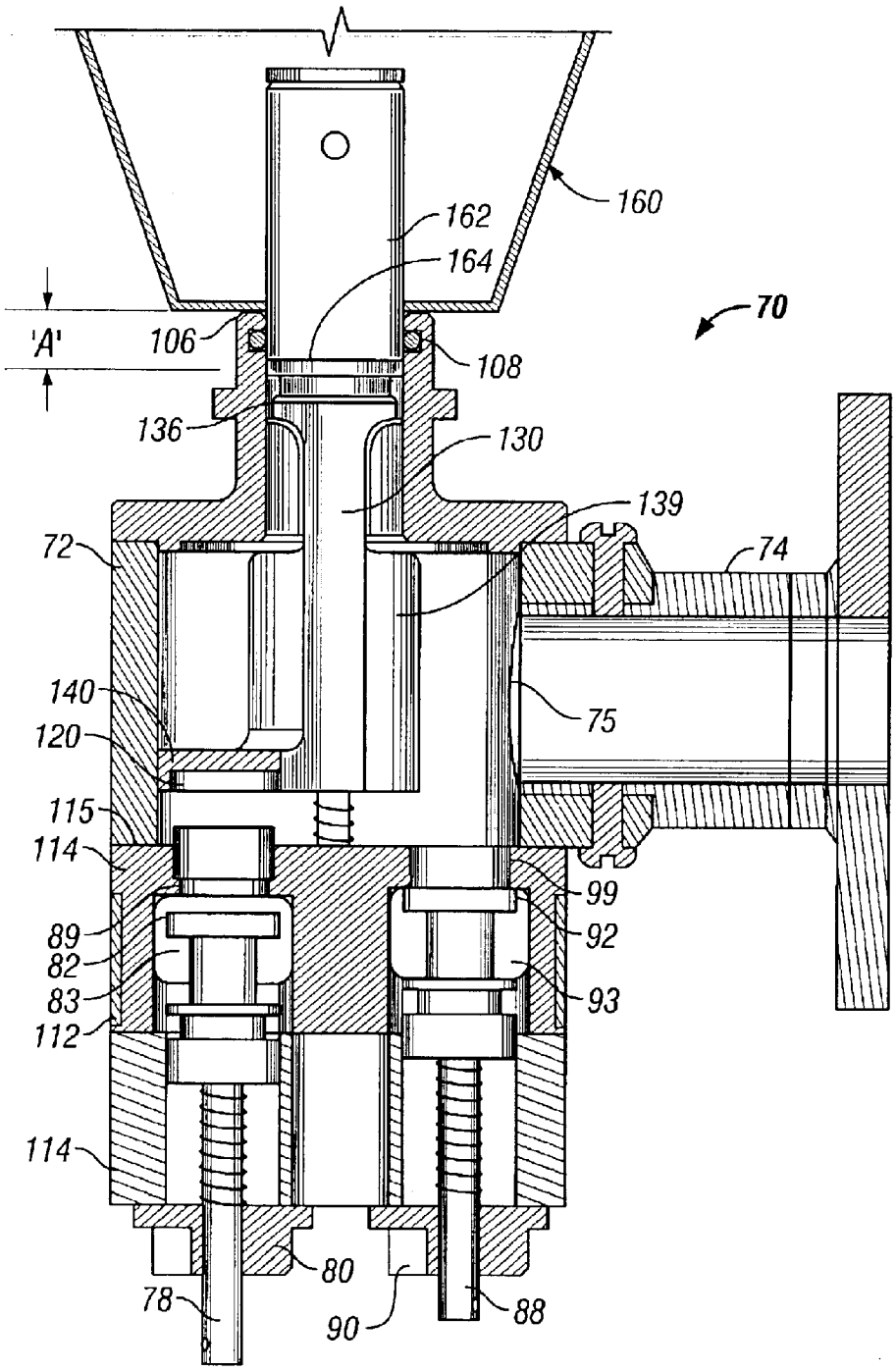
FIG. 5 is a cross-sectional view of the relief valve depicted in FIG. 1., which shows the pressure insert permitting flow to a lower pressure outlet.
Figure 6:
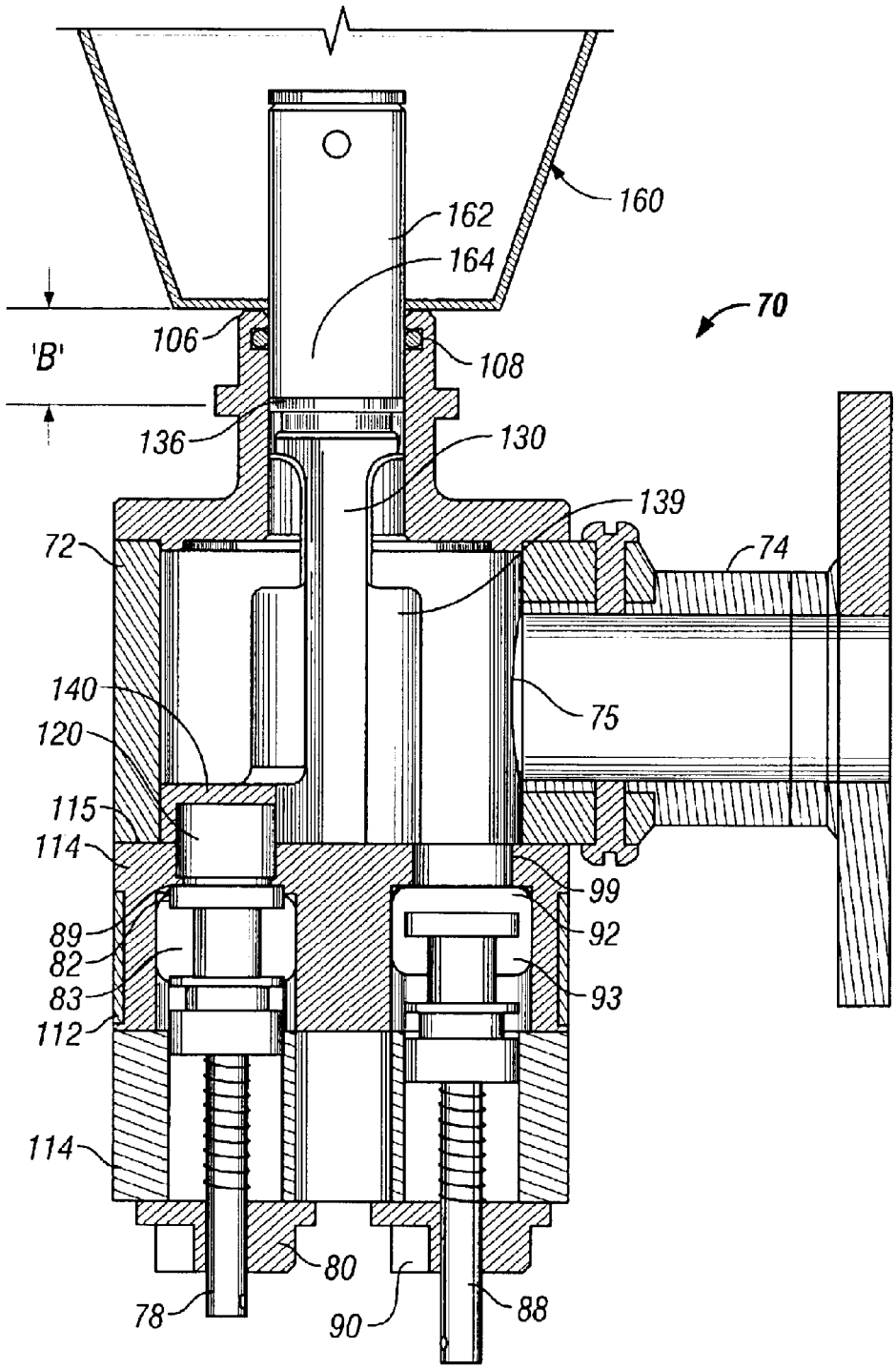
FIG. 6 is a cross-sectional view of the relief valve depicted in FIG. 1., showing the pressure insert stopping flow to the lower pressure outlet.

In FIGS. 5 and 6, the diameters and the generally cylindrical shapes of filler tubes 162, 182 are identical for both of the tools. A significant difference between filler tubes 162, 182 is that distal end 184 of filler tube 182 protrudes a greater distance "B" from body 180 (shown in FIG. 6) of its respective tool, as compared to the distance "A" that distal end 164 of filler tube 162 protrudes from body 160 (shown in FIG. 5) of its respective tool. The difference in distances "A" and "B" is utilized by relief valve 70 to select the appropriate relief pressure and volumetric relief capacity for each of the tools. In this example, the tool associated with body 180 requires a higher relief pressure setting and a lower volumetric relief capacity, as compared to the relief pressure setting and the volumetric relief capacity of the tool associated with body 160.

FIG. 5 depicts internal components of relief valve 70 during an overpressure relief by lower pressure piston assembly 80 and outlet 83. As is normal during filling, distal end 164 of filler tube 162 is inserted as far as possible into outlet 106, further insertion being obstructed by body 160. The distance that filler tube 162 is inserted is labeled distance "A" in FIG. 5. Significantly, at distance "A," distal end 164 of filler tube 162 does not reach end 136 of pressure insert 130. In the absence of any force that might otherwise be exerted on filler tube 162 by pressure insert 130, bias springs 134 hold pressure insert 130 away from base plate 114 so that a relief flow path is open from inlet 75 to channel 89. Internal over-pressure within body 72, exerted by, for example, drywall compound delivered by pump 50, overcomes compression spring 84 (shown in FIG. 4) and, consequently, forces seat 82 away from the mating seat inside channel 89. Excess drywall compound from the interior of body 72 travels through channel 89 and exits relief valve 70 via low pressure outlet 83.

During this overpressure relief by lower pressure piston assembly 80 and outlet 83, a relief flow path is also open from inlet 75 to channel 99, in which higher pressure piston assembly 90 is housed. However, because calibration nut 96 is adjusted to cause compression spring 94 to exert a greater force, as compared to compression spring 84, the internal pressure within body 72 is insufficient to force seat 92 away from the mating seat within channel 99. Consequently, no drywall compound flows through channel 99 or exits from high pressure outlet 93.

FIG. 6 depicts internal components of relief valve 70 during an overpressure relief by higher pressure piston assembly 90 and outlet 93. Distal end 184 of filler tube 182 is inserted as far as possible into outlet 106. As can be seen in FIG. 6, filler tube 182 protrudes a distance "B" beyond body 180 of its associated tool. At distance "B," distal end 184 of filler tube 182 presses on end 136 of pressure insert 130 so that bias springs 134 are overcome and mantle portion 140 abuts interior face 115 of base plate 114, stopping flow to channel 89. Also, dam 120 is received into depression 131 (best seen in FIG. 8) of mantle portion 140 to further block flow to channel 89.

As a result, the full internal pressure of the drywall compound or other liquid within body 72 cannot act on lower pressure piston assembly 80. Consequently, seat 82 remains sealed against the mating seat of channel 89, and the relief pressure setpoint of higher pressure piston assembly 90 is effectively selected. When the liquid pressure within body 72 reaches the setpoint of higher pressure piston assembly 90, seat 92 is forced away from the mating seat inside channel 99 to open a relief flow path from body 72 through channel 99 and out relief outlet 93.

Figure 7:
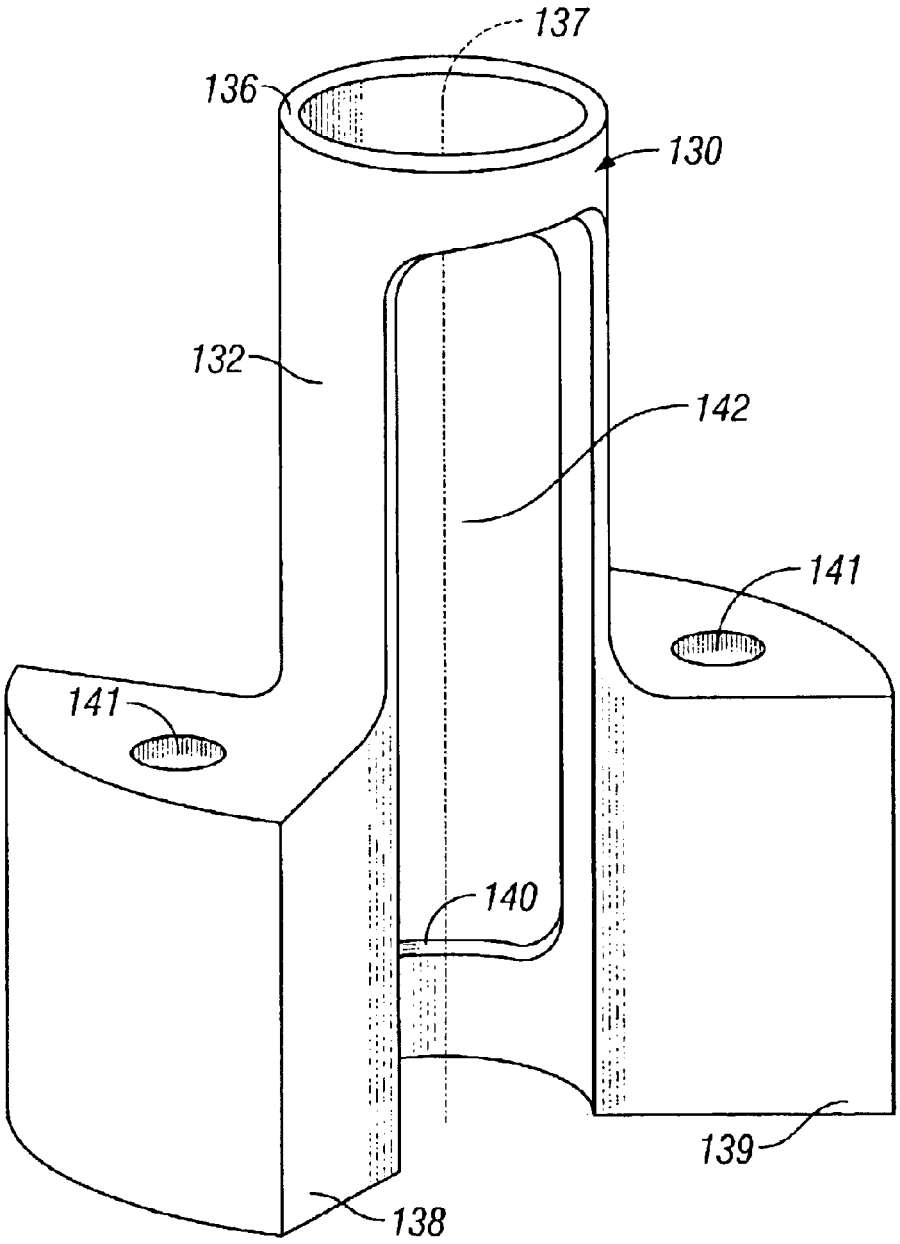
FIG. 7 is a perspective view of the pressure insert of FIG. 5.

Referring now to FIG. 7, pressure insert 130 includes hood 132, which forms end 136, bore 137 and at least one opening 142. Bore 137 and opening 142 communicate in a flow path, suitable for passing drywall compound from inlet 75 to outlet 106 of relief valve 70 during normal operation.

Figure 8:
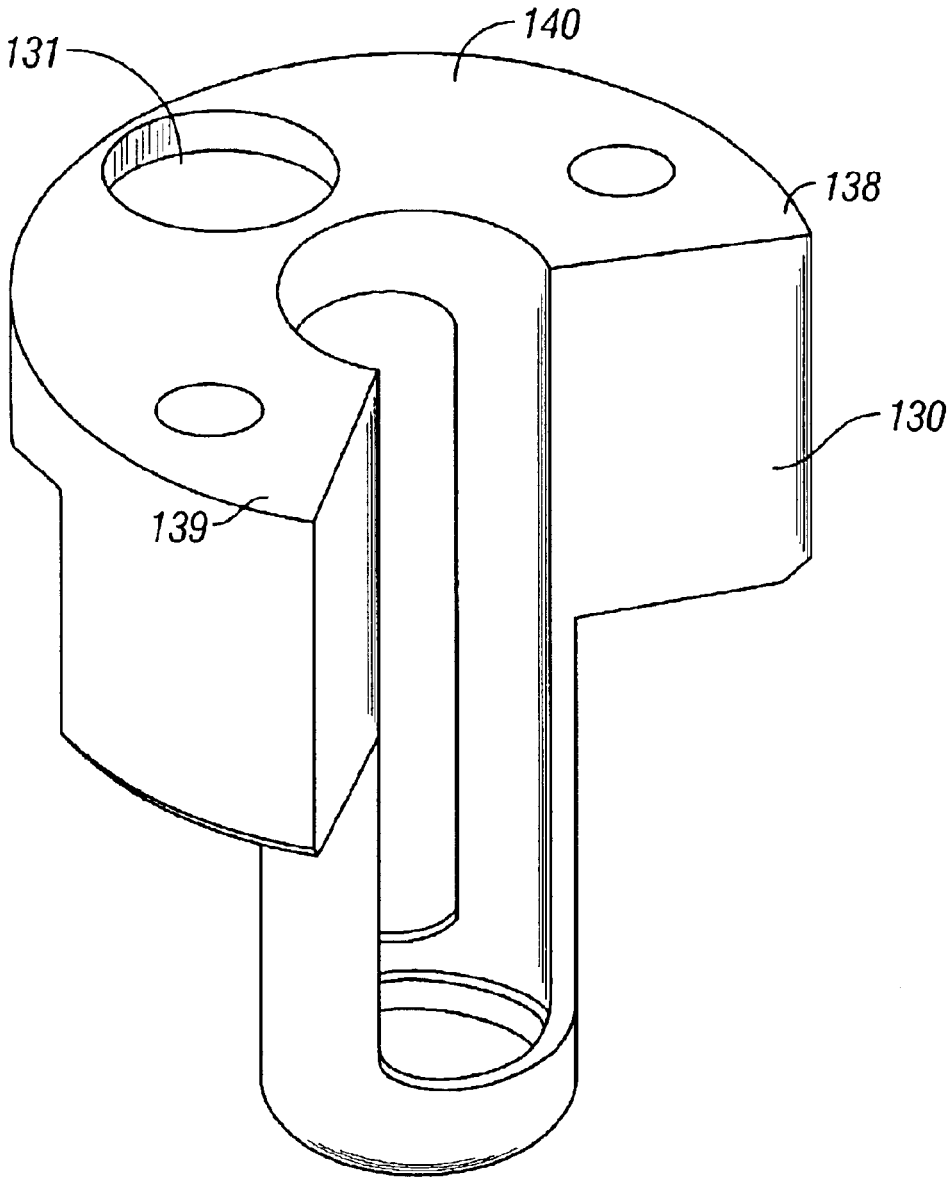
FIG. 8 is another perspective view of the pressure insert of FIG. 5.

Hood 132 is mounted on pillar portions 138, 139, which are joined by mantle portion 140. Pillar portions 138, 139 are approximately diametrically opposed and include holes 141 for receiving spring guides 132 (best seen in FIG. 4), respectively. Together, the three portions 138, 139, 140 form a solid mass having a generally flat underside that is suitable for mating with interior face 115 of base plate 114. As can be seen in FIG. 8, mantle portion 140 of pressure insert 130 includes depression 131 for receiving dam 120 when mantle portion 140 (not shown) abuts base plate 114.

In summary, an operator may connect a tool for delivering drywall compound to one of at least two pressure relief outlets of a relief valve connected to a drywall compound pumping assembly. The relief valve automatically determines the maximum pressure suitable for the connected tool and prevents the pumping assembly from delivering drywall compound under excessive pressure to the tool.

In other embodiments (not shown), the present invention may include relief channels, corresponding to channels 89 and 99, having cross-sectional areas that are not identical to each other. The individual relief channels may be constructed in sizes to meet the volumetric relief requirements of particular tools. Also, a pressure insert corresponding to pressure insert 130 may be biased to normally stop the relief path to a lower pressure piston assembly, corresponding to lower pressure piston assembly 80. In that case, a tool with a protruding filler tube presses against the pressure insert to open a relief flow path to a higher pressure piston assembly.

Additionally, other physical characteristics of the tools may be relied upon to select the appropriate pressure relief setpoint. For example, the selection may be based on the relative diameters, shapes or curvatures of the filler tubes. Alternatively, the outlet of the selective relief valve may be a male member, and the appropriate relief pressure may be selected based on the length to which the tool receives the male member. These and other modifications readily apparent to those of ordinary skill in the art are intended to be within the scope of the invention, as set forth in the appended claims.

That which is claimed is:

1. A relief valve for connecting to either of two vessels, each of the vessels having a different overpressure limit, the relief valve comprising:

a body;

an inlet in the body;

a discharge outlet in the body for connecting to either of the two vessels;

a first pressure relief outlet in the body for providing overpressure protection against a first pressure limit;

a second pressure relief outlet in the body for providing overpressure protection against a second pressure limit; and a selector member in the body that is actuated by one of the vessels when the discharge outlet is connected to one of the vessels; the selector member, when actuated, blocking flow to either the first pressure relief outlet or the second pressure relief outlet.

2. The relief valve of claim 1 in which a first spring-loaded piston and seat assembly is between the inlet and the first relief outlet.

3. The relief valve of claim 1 in which a second spring-loaded piston and seat assembly is between the inlet and the second relief outlet.

4. The relief valve of claim 1 in which the selector member is actuated when the one of the vessels is inserted at least a predetermined distance into the discharge outlet.

5. The relief valve of claim 1 in which the selector member is actuated when one of the vessels having a cross-section of a predetermined shape and size is inserted into the discharge outlet.

6. The relief valve of claim 1 in which the selector member is actuated by one of the vessels into which the discharge outlet is inserted at least a predetermined distance.

7. The relief valve of claim 6 in which the discharge outlet includes a receptacle having a cross-section of a predetermined shape and size.

8. The relief valve of claim 1 and a relief channel that communicates with the body, wherein the selector member is spring-biased between a position adjacent the discharge outlet and a position that covers the relief channel.

9. The relief valve of claim 8 in which the relief channel has a mouth, the mouth is surrounded by a dam, and the selector member includes a depression for receiving the dam when the selector member is actuated.

10. A relief valve for protecting either of two batch application tools, each of the tools having a different overpressure limit and a different pressure connector, the relief valve comprising:

a body;

an inlet in the body;

a discharge outlet in the body for connecting to either of the two batch application tools;

a low pressure relief outlet in the body for providing overpressure protection against a first pressure limit;

a high pressure relief outlet in the body for providing overpressure protection against a second pressure limit; and a selector member that is actuated by one of the pressure connectors when the discharge outlet is connected to one of the tools; the selector member, when actuated, blocking flow to the lower pressure relief outlet.

11. The relief valve of claim 10 in which a low pressure spring-loaded piston and seat assembly is between the inlet and the low relief outlet.

12. The relief valve of claim 10 in which a high pressure spring-loaded piston and seat assembly is between the inlet and the high pressure relief outlet.

13. The relief valve of claim 10 in which the selector member is actuated when a pressure connector is inserted at least a predetermined distance into the discharge outlet.

14. The relief valve of claim 10 in which the selector member is actuated by a pressure connector having a fill tube inserted at least a predetermined distance into the discharge outlet.

15. The relief valve of claim 10 in which the relief valve includes a relief channel having a mouth that communicates with the body, the selector member is spring-biased, and, when actuated, the selector member moves away from the discharge outlet to block flow to the mouth.

16. The relief valve of claim 15 in which the mouth is surrounded by a dam and the selector member includes a depression for receiving the dam when the selector member is actuated.

17. The relief valve of claim 15, which includes:

a latch that is mounted on the body and a removable cap that provides access to the interior of the body for cleaning, the latch releasably attaching to the cap to the body.

18. The relief valve of claim 17 in which all components located in the interior of the body are securely mounted to the body so that removing the cap from the body and flushing the body with a solvent does not result in displacement or loss of any of the components.

19. A pumping system for filling two batch application tools, each of the tools having a different overpressure protection limit, the pumping system comprising:

a motor;

a pump driven by the motor and having an effluent conduit;

a relief valve including a body, an inlet that communicates with the effluent conduit, a discharge outlet, a first pressure relief outlet, a second pressure relief outlet; and a selector member that is actuated when the discharge outlet is connected to one of the tools, the selector member, when actuated, blocking flow to one of the pressure relief outlets.

20. The pumping system of claim 19 in which the relief valve includes:

a first spring-loaded piston and seat assembly adjusted to provide the overpressure protection for one of the tools and positioned between the inlet and the first pressure relief outlet; and a second pressure spring-loaded piston and seat assembly adjusted to provide the overpressure protection for the other of the tools and positioned between the inlet and the second pressure relief outlet.

21. The pumping system of claim 19 in which the selector member is actuated when one of the tools is inserted at least a predetermined distance into the discharge outlet.

22. The pumping system of claim 19, which includes a relief channel in the relief valve that communicates with the body and wherein the selector member is spring-biased between a position adjacent the discharge outlet and a position that blocks flow to the relief channel.

23. The pumping system of claim 19, which includes a frame that is releasably attached to the pump by a clamp and wherein the pump is releasably coupled to the motor by a removable pin.

* * * * *